United States Patent [19]

Malcolm

[11] 4,270,750

[45] Jun. 2, 1981

[54] STATIONARY ROPE CLIMB EXERCISE DEVICE

[76] Inventor: Roger J. Malcolm, 1701 28th Ave., South, Birmingham, Ala. 35209

[21] Appl. No.: 936,401

[22] Filed: Aug. 24, 1978

[51] Int. Cl.[3] ..... A63B 21/04

[52] U.S. Cl. ..... 272/136; 272/140; 254/375; 242/99

[58] Field of Search ..... 272/136, 86, 140, 142, 272/DIG. 4, 131, 132, 112; 242/75.4, 75.43, 99; 267/69; 254/149

[56] References Cited

U.S. PATENT DOCUMENTS

| | | | |
|---|---|---|---|
| 641,519 | 1/1900 | Kerns | 272/132 UX |
| 913,799 | 3/1909 | Zund-Burguet | 272/140 |
| 1,416,741 | 5/1922 | Nicholls et al. | 272/136 |
| 3,782,718 | 1/1974 | Saylor | 272/112 |

FOREIGN PATENT DOCUMENTS

| | | | |
|---|---|---|---|
| 263306 | 12/1949 | Switzerland | 272/140 |

*Primary Examiner*—William R. Browne

*Attorney, Agent, or Firm*—Colton & Stone, Inc.

[57] ABSTRACT

An exercise device which enables one to experience the benefits of rope climbing exercise while remaining on the ground. A rope extends between upper and lower winding drums. Tensioning springs are associated with the upper drum to provide increasing tension on the rope as it is pulled downwardly.

10 Claims, 7 Drawing Figures

STATIONARY ROPE CLIMB EXERCISE DEVICE

The present invention relates to exercise devices and, more particularly, to an exercise device of the rope climb type.

BACKGROUND OF THE INVENTION

Rope climbing as an exercise traditionally involves a rope suspended from a relatively high point such as a gymnasium ceiling. In ordinary low ceilinged rooms, conventional rope climbing is not feasible. There is also an element of danger in conventional rope climbing as the climber may slip or fall. In the U.S. Patents to Kerns, No. 641,519, and Saylor, No. 3,782,718, rope climb exercise devices which utilize endless ropes are disclosed, the Kerns device incorporating and adjustable friction brake to regulate the effort required by the user and the Saylor device using a variable speed electric motor for the same purpose. With both of these devices, however, the mechanical resistance encountered by the user remains constant regardless of the effective distance of the climb.

It is an object of the present invention to provide a device offerring the benefits of rope climbing exercises without requiring the use of a long rope suspended from a relatively high point.

It is also an object of the invention to provide a rope climb type exercise device which allows the effort expended by the user to be varied to suit the user's abilities.

A further object of the invention is the provision of a stationary rope climb exercise device in which the effort required of the user increases with the length of the climb.

BRIEF DESCRIPTION OF THE INVENTION

The above and other objects of the invention which will become apparent in the following detailed description are achieved by the provision of a rope climb exercise device having a platform and a frame extending above the platform, a rope extending between an upper winding drum journalled on the frame and a lower winding drum housed beneath the platform, tensioning means attached to the upper drum and means to wind the rope on the lower drum. Safety devices including a centrifugal brake to limit the maximum speed at which the rope is wound and unwound from the drums are also provided.

For a more complete understanding of the invention and the objects and advantages thereof reference should be had to the following detailed description and the accompanying drawings wherein preferred embodiments of the invention are described and shown.

DETAILED DESCRIPTION OF THE PREFERRED EMBODIMENTS

Figure 2:
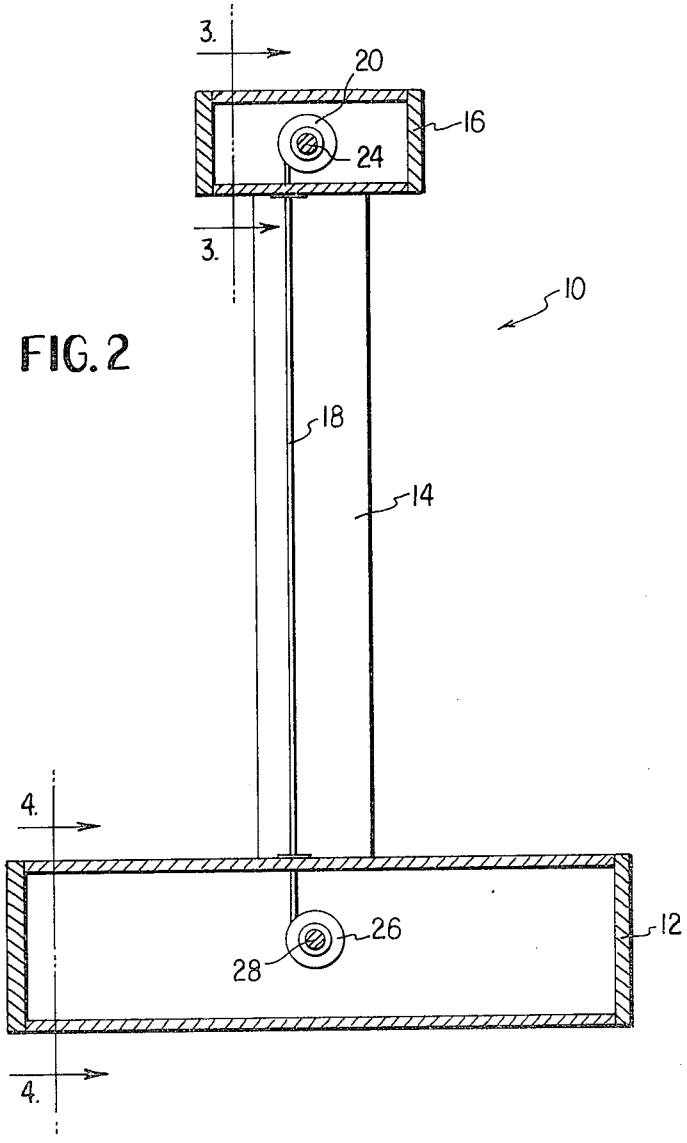
FIG. 2 is a transverse cross-sectional view taken along the line 2—2 of FIG. 1.

The rope climb exercise of my invention, designated generally by the reference numeral 10, has a base 12, vertical columns 14 at opposite sides of the base 12 and an upper housing 16. A length of rope 18 extends between an upper winding drum, 20 carried on a shaft 24 in the upper housing 16 and a lower winding drum 26 carried on a shaft 28 housed in the base 12. As will be described in detail below, within the upper housing 16 there is provided an adjustable tensioning mechanism operating, through the drum 20, to apply tension to the rope 18. The base houses, in addition to the lower winding drum 26, a manual brake by which the user can lock the rope in a tensioned state and a centrifugal brake serving to prevent the rope from rewinding onto the upper drum at excessive speed.

Figure 3:
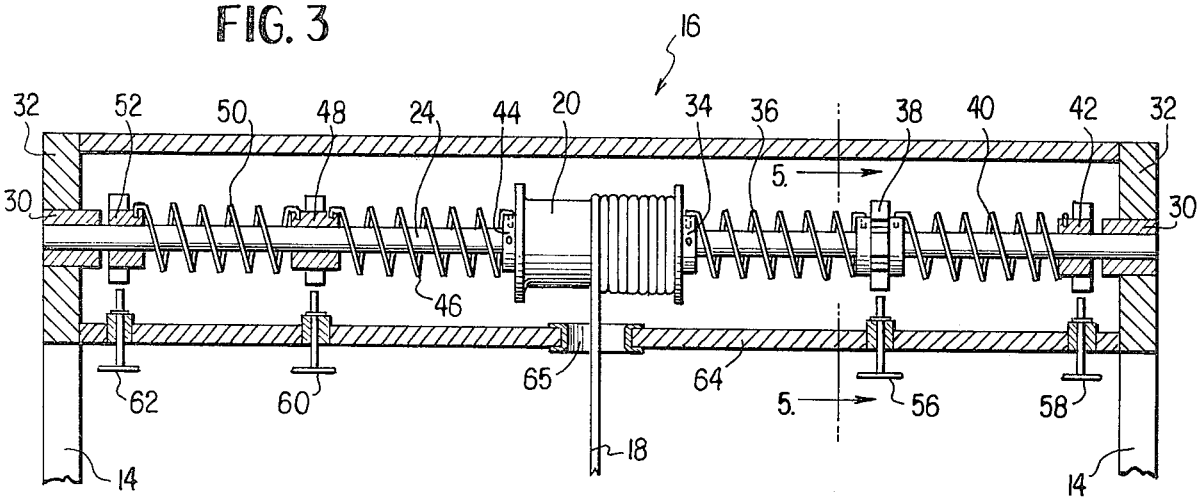
FIGS. 3 and 4 are fragmentary cross-sectional views taken along the lines 3—3 and 4—4, respectively, of FIG. 2.
Figure 5:
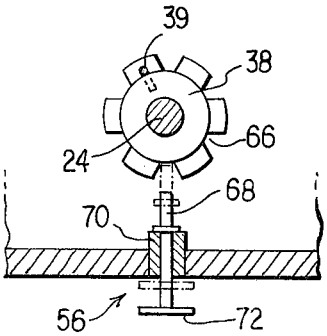
FIG. 5 is a fragmentary cross-sectional view taken along the line 5—5 of FIG. 3.

As can be seen from FIG. 3, the shaft 24 carrying the upper winding drum 20 is journalled in bearings 30 in the opposite end walls 32 of the upper housing. A collar 34 at one end of the winding drum 20 holds one end of a first coil spring 36 the opposite end of which is attached to an intermediate collar 38. The spring 36, which is concentric with the shaft 24 and of larger internal diameter than the shaft, is arranged so that rotation of the drum 20 as rope is unwound therefrom and the collar 38 is held stationary, winds the spring up, increasing the tension thereof. Referring to FIG. 5, associated with the collar 38 is a locking mechanism 56. The circumference of the collar has a plurality of notches 66 any one of which may be engaged by a locking rod 68 slidably mounted in a bushing 70 carried by the bottom wall 64 of the upper housing. A handle 72 is provided in the lower end of the rod 68. Additional springs 40, 46, 50 and locking collars 42, 48, 52 are provided along the length of the shaft 24. It will be apparent that, by selecting the particular latches 56–62 which are engaged with their respective collars, the number of coil springs in winding relation to the drum 20 may be varied as desired, thus varying the tension on the rope 18 as it is pulled downwardly. Completing the description of the mechanism, a rope guide bushing 65 is provided in the housing bottom wall.

Figure 4:
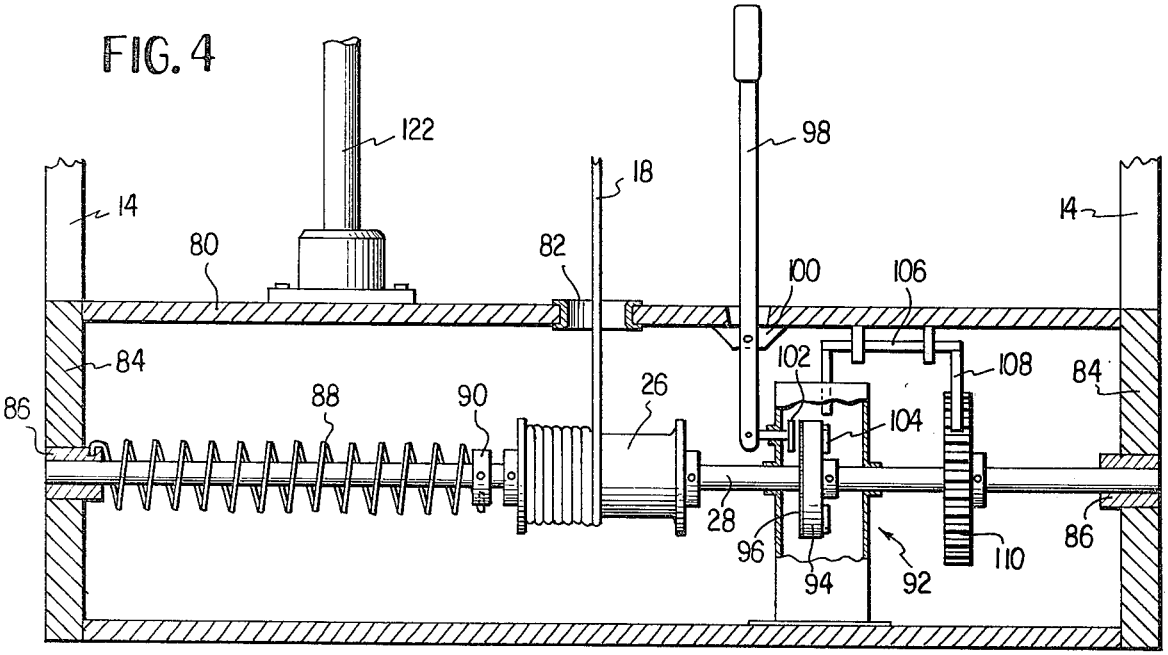

The mechanism housed within the base 12 is illustrated in FIG. 4 and includes a coil spring 88 one end of which is attached to the lower winding drum shaft by a collar 90 and the opposite end of which is attached by a collar 86 to the end wall 84 of the base housing. This spring serves to wind the rope onto the lower drum. A brake mechanism 92 is also provided on the shaft 28, the brake mechanism including a drum 94 having a friction surface 96. A brake actuating lever 98 pivoting as a bracket 100 connected to the upper wall 80 of the base 12 carries, at its lower end, a brake shoe 102 positioned so as to brakingly engage the friction surface. This arrangement allows the user to temporarily hold the rope under tension without requiring the rope to be gripped in the hands. The brake mechanism further includes a speed responsive brake including weights 104 mounted on the drum 94 in such manner as to swing outwardly under centrifugal force if the speed of the shaft 28 exceeds a predetermined value. The outwardly swinging weights strike a trip lever designated generally by the numeral 106, causing a latching pawl 108 to engage a ratchet wheel 110. This mechanism is a safety feature, preventing the sudden upward movement of the rope if it is released while the springs of the upper housing are tensioned.

Figure 1:
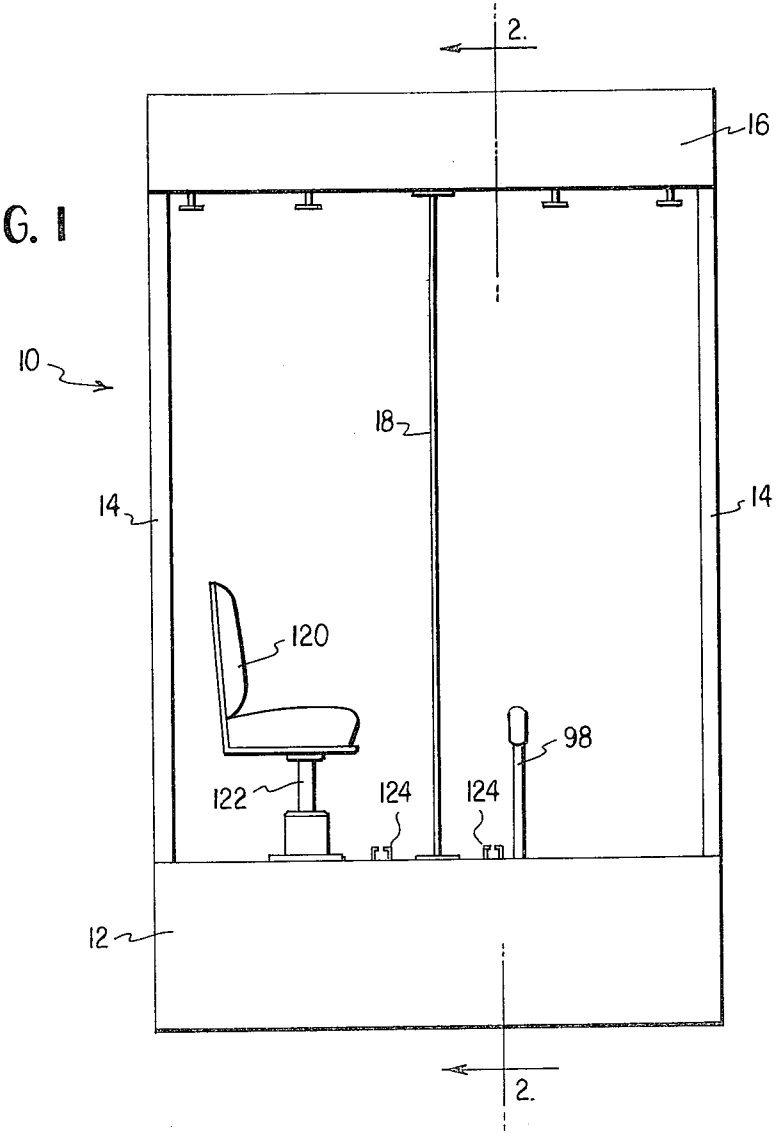
FIG. 1 is a front elevational view of a preferred embodiment of the exercise device of my invention.

Referring again to FIG. 1, the exercise device preferably is provided with a seat 120 supported by a column 122 and movable between a position adjacent to the rope 18 and a laterally offset position. Clamps 124 may also be provided adjacent the rope 18 for engaging the wheels of a wheelchair or for holding the user's feet.

In using the exercise device of my invention, the rope is initially wound on the upper drum 20 and, by engaging selected ones of the spring collar latches 56–58, the tension which can be developed is determined. The user then proceeds to pull the rope downwardly in a hand-over-hand manner as is used in climbing a stationary rope. If the user desires to momentarily stop, the brake lever 98 allows the rope to be held in its tensioned state while the user releases his hands therefrom. Should the rope be released without engaging the manual brake, the speed responsive brake mechanism will automatically engage to prevent rapid upward movement of the rope which could result in rope burns or other injury. The experience of climbing down is duplicated by holding the rope in a hand-over-hand manner as it is rewound on the upper drum under the action of the coil springs within the upper housing.

Figure 6:
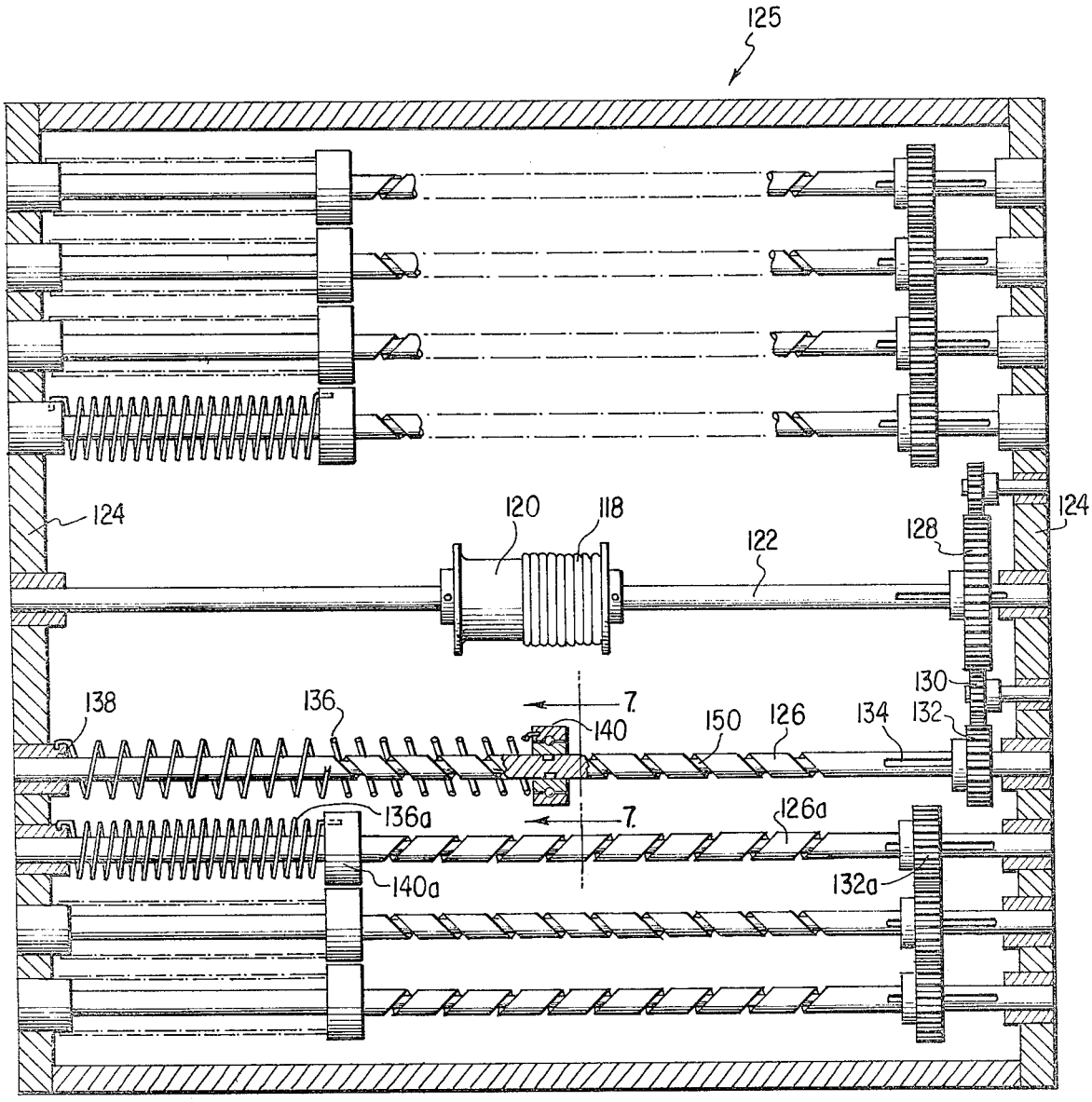
FIG. 6 is a horizontal cross-sectional view of the upper housing of a second embodiment of the exercise device of my invention.
Figure 7:
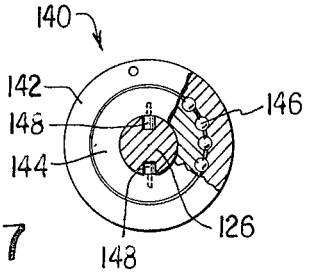
FIG. 7 is a fragmentary cross-sectional view taken along the line 7—7 of FIG. 6.

It will be understood that changes and additions may be made in and to the embodiment of my invention described above. One such modification is illustrated in FIGS. 6 and 7. In this modification, the rope 118 is wound on an upper winding drum 120 carried by a shaft 122 journalled in bearings at opposite side walls 124 of the upper housing 125. Extending parallel to the drum shaft 122 and also journalled at the side walls 124 are a plurality of shafts 126. A gear 128 is keyed to the drum shaft 122 adjacent one end thereof and is in meshing engagement with one or more idler gears 130. Each of the shafts 126 is provided with a gear 132 slidable on a splined portion of the shaft. By means of a shift lever (not shown) the gear 132 may be shifted to a position in which it meshes with idler gear 130 so that the shaft 126 rotates as the drum shaft 122 rotates upon winding or unwinding of the rope. An expansion coil spring 136 surrounds the end of the shaft 126 remote from the gear 132. One end 138 of this spring is affixed to the housing side wall 124 and the opposite end is affixed to a bushing 140. As can be seen in FIG. 7, the bushing 140 has an outer sleeve 142 to which the end of the spring 136 is attached, and an inner housing 144, ball bearings being provided between the inner and outer bushings. A pair of rollers 148 project radially inwardly from the inner circumference of the bushing 144. These rollers engage spiral grooves 150 extending along the shaft 126.

With the arrangement described in the preceeding paragraph, rotation of the drum shaft 122 as the rope is pulled downwardly by the user causes, through the gears 128, 130 and 132, rotation of the shaft 126. As the shaft rotates, the bushing 140 travels along the spiral grooves 150, elongating the spring 136 and, thereby, increasing the tension on the rope 118.

As with the embodiment of FIGS. 1–5, means are provided for selecting the tension applied to the rope and hence, the effort which the exercises exerts in using the device. Thus, by shifting the positions of the gear 132*a* of the shaft 126*a* into meshing engagement with the gear 132 of shaft 126 which is drivingly connected to the drum shaft gear 128, two springs 136 and 136*a* are tensioned as the rope is unwound. In the arrangement shown in FIG. 6 any number of springs up to ten may be used by shifting appropriate ones of the gears into meshing engagement. Obviously, a greater or lesser number of springs could be provided.

It will be apparent that while two rope tensioning spring arrangements have been shown and described, other arrangements may also be employed to accomplish the same function. For example, torsion bars may be used in place of the coil springs 36, 40 etc. Likewise, the brake mechanism consisting of drum 94, friction surface 96 and brake shoe 102 may be replaced by any other suitable brake mechanism such as a strap and drum brake. In a similar manner, any speed responsive brake may be substituted for the centrifugal brake shown in FIG. 4. Since these and other changes may be made in and to the device of my invention without departing from the spirit thereof, reference should be had to the following claims in determining the true scope of the invention.

I claim:

1. A rope climb exercise device comprising:

a base;

a housing;

column means supporting said housing above said base;

a first winding drum journalled within said housing;

a second winding drum journalled within said base;

a rope connected at one end to said first drum and at its opposite end to said second drum and of such length as to be alternately would on said first and second drums;

tensioning means mounted in said housing and connected to said first winding drum and operative to apply progressively increasing tension to said rope as it is unwound from said upper drum; and means for rotating said second winding drum to wind said rope thereon.

2. The device of claim 1 further including brake means operatively connected to said lower drum for selectively maintaining tension on said rope.

3. The device of claim 2 wherein said brake means includes a speed responsive brake.

4. The device of claim 2 wherein said brake means includes a manually actuatable brake.

5. The device of claim 1 wherein said tensioning means comprises spring means.

6. The device of claim 5 wherein said spring means comprises a plurality of springs and further including means to selectively connect individual ones of said spring means in operative engagement with said upper winding drum.

7. The device of claim 6 wherein said springs are coil springs, said upper winding drum being carried on a shaft extending the length of said housing, and said coil springs being sequentially located along said shaft.

8. A rope climb exercise device comprising:

a base;

a housing;

means supporting said housing in spaced position above said base;

a first winding drum journalled within said housing;

a second winding drum journalled within said base;

a rope connecting at one end to said first drum and at its opposite end to said second drum and of sufficient length as to be wound a plurality of times on either of said drums;

spring means mounted in said housing and operatively connected to said upper winding drum, said spring means being in untensioned condition when said rope is fully wound on said upper winding drum and being progressively tensioned as said rope is unwound from said upper winding drum; and means for rotating said lower winding drum to wind said rope thereon.

9. The device of claim 8 wherein said spring means includes a plurality of springs and means to selectively connect individual ones of said springs into tensioning relation with said upper winding drum.

10. The device of claim 8 further including brake means operatively connected to said lower drum for selectively maintaining tension on said rope.

* * * * *